United States Patent [19]

Blagg

[11] Patent Number: 4,908,891

[45] Date of Patent: Mar. 20, 1990

[54] STABLE BACK REST

[76] Inventor: Leon Blagg, Rte. 2, Box 27, Marble Falls, Tex. 78654

[21] Appl. No.: 248,982

[22] Filed: Sep. 26, 1988

[51] Int. Cl.[4] ..... A47G 9/00

[52] U.S. Cl. ..... 5/419; 5/432; 297/352

[58] Field of Search ..... 5/418, 419, 432, 433; 297/352

[56] References Cited

U.S. PATENT DOCUMENTS 1,930,942 10/1933 Pringle ..... 5/419
2,304,700 12/1942 Manville ..... 5/419 X
3,822,424 7/1974 Messer ..... 5/419
4,466,517 8/1984 Spiegelman ..... 5/419 X

*Primary Examiner*—Michael F. Trettel
*Attorney, Agent, or Firm*—Dodge Bush & Moseley

[57] ABSTRACT

In accordance with an illustration embodiment of the invention, a stable, portable back rest includes front and rear panels hinged together and set up in an inverted Vee, the front panel having an opening in its lower section which defines a horizontal edge, the end portion of a beach towel being inserted through the opening and wrapped more than one full turn around the lower section. When the user sits on the towel and leans back against the front panel, forces are applied at such edge while resist collapse and overturning of the panels.

7 Claims, 1 Drawing Sheet

STABLE BACK REST

FIELD OF THE INVENTION

This invention relates generally to a back support or rest for use by an individual who is reclining on a beach or the like, and particularly to a new and improved portable back support having a reduced tendency to collapse or overturn during use.

BACKGROUND OF THE INVENTION

Various back rests have been proposed for a user to lean back against while reposing on a beach, or other rest and recreational area. One particular prior device has a series of four panels hinged end-to-end, with the two front panels laying out on the ground to provide a seat area, and the two rear panels being arched upward in an inverted "V" to provide a back support. However this outfit is bulky even when folded, and tends to get soiled because the two front panels engage the ground. Another known device has a tubular steel frame that includes front and back sections hinged together, the front section having a canvas back rest attached to its edges. A relatively short, foam-padded seat is attached to the lower horizontal tube of the front section, and extends outward in contact with the ground. This device also has the disadvantage that the ground-engaging seat is easily soiled, and the construction is such that nothing tends to prevent collapse of the assembly until it is already tipping backward. Yet another prior back rest comprises crossed sticks having lower ends that are pressed into the sand or grass. An elongated fabric piece has its top corners fastened by snaps to the top ends of respective sticks. This device is inherently unstable, and shares the principle problem encountered in using most prior devices in that the assembly tends to collapse in use, which can be a considerable irritation, particularly when collapse comes as a surprise.

An object of the present invention is to provide a new and improved portable back support of the type described which has a greatly reduced tendency to fold or collapse in use.

Another object of the present invention is to provide a new and improved back support that is readily portable, and easy to set up and use.

Another object of the present invention is to provide a new and improved back support that is simple and reliable in use, economical to manufacture, and which eliminates soiling and wearing of any ground-contacting part.

Still another object of the present invention is to provide a light weight, compact back rest unit that is unencumbered with bulky cushions, and is especially adapted for a traveler to pack in a suitcase and use with a towel that typically is available at the site.

SUMMARY OF THE INVENTION

These and other objects are attained in accordance with the concepts of the present invention through the provision of a back rest or support comprising a pair of rectangular panels that are hinged together at adjacent edges so that they can be folded together for carrying, and then set up in an inverted "V" on a ground surface. The front one of the panels is provided with a window toward its lower edge for receiving the end portion of a towel. The towel end portion is wrapped more than one full turn around that section of the front panel located between the lower straight edge of the window and the lower ground engaging edge of the panel, so that the said inner end portion of the towel is lapped back upon itself.

Thus arranged, it can be demonstrated that the weight of the user who sits on the towel and leans back against the front panel produces a force balance that prevents the back rest from tipping over backward. Specifically, that length of the towel which extends forward and downward from the lower edge of the window to the ground contact area under the seat of the user is placed in tension. Such tension is the resultant of two component forces, one of which resists collapse of the inverted Vee, and the other of which produces an equal and opposite moment to that which tends to cause the top of the front panel to pivot rearward. Thus the back rest of the present invention will not fold up or collapse in use, and otherwise achieves the objectives stated above.

The invention has other objects, features and advantages which will become more clearly apparent in connection with the following detailed description of a preferred embodiment, taken in conjunction with the appended drawings.

DETAILED DESCRIPTION OF A PREFERRED EMBODIMENT

Figure 1:
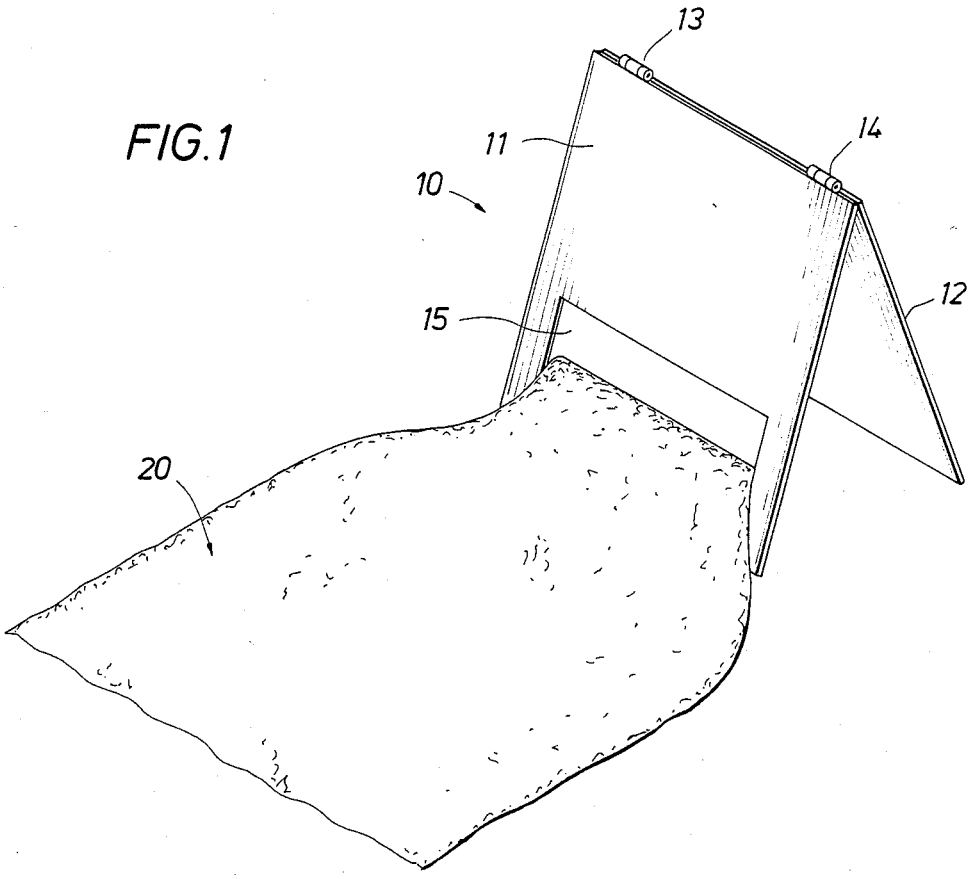
FIG. 1 is a perspective view of the present invention.

Referring initially to FIG. 1, a portable back rest assembly 10 constructed in accordance with the invention includes a pair of rectangular shaped panels 11 and 12 which are joined together at their respective upper edges by hinges 13, 14. The wings of the hinges 13, 14 are attached to the inner upper sides of the panels 11, 12 so that the panels can be folded flat against one another for carrying, and then set up at the site of use in an inverted "V" configuration as shown. The panels 11, 12 can be made out of plywood or similar material, or can be made of plastic using an injection molding process. If desired, the panels can have a covering of a suitable waterproof, durable material that provides a decorative appearance. Suitable peripheral dimensions of each of the panels 11, 12 can be 18 inches high and 16 inches wide.

Figure 2:
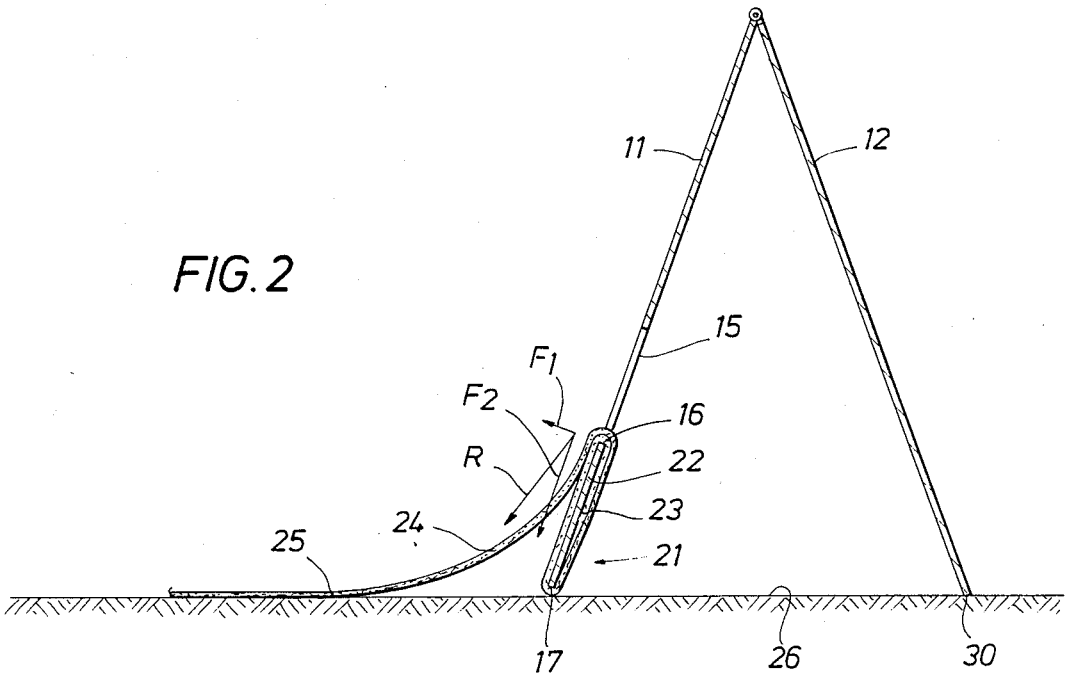
FIG. 2 is cross-section view from the left side to illustrate how the towel is extended through the window and secured to the lower portion of the front support panel.

The front panel 11 has a window 15 formed in the lower half thereof, which can have various shapes so long as the lower edge 16 (FIG. 2) of the window is substantially parallel to the bottom edge 17 of the panel 11. A towel 20, such as a standard beach towel made of terry cloth or the like, which is carried separate by the user prior to set-up, has its rear portion 21 inserted through the window opening 15 as shown in FIG. 1, and then wrapped around the lower section 22 of the panel 11 as shown in FIG. 2. As indicated, the towel portion 21 is wrapped more than one full turn around the section 22, and positioned such that the terminal edge 23 of the towel is located about midway down the back surface of the panel portion 22. That part 24 of the towel 20 which leads from the edge 16 of the opening 15 is draped so as to extend downward and forward, as shown, between such edge and the first region 25 of contact with the ground 26.

The back support assembly 10 and the towel 20 are carried separate by the user to the site, the panels 11,12 being folded flat against one another for convenience of carrying. In order to set the assembly up, the rear portion 21 of the towel 20 is inserted through the window 15 in the front panel 11 and wrapped around the lower section 22 in a clockwise direction, with the end edge 23 of the towel being located on the back side of the section 22 as shown in FIG. 2. Thus the rear portion of the towel laps over itself so that tension in the towel portion 24 will produce a self-tightening effect, particularly at the edge 16 of the opening 15. Then the assembly 10 is folded in the shape of an inverted "V", and set down on the ground surface 26 with the rest of the towel 20 stretched out in the forward direction.

When the user sits down on the towel 20 near the front panel 11 and leans backward, the draped portion 24 is placed in tension which is indicated by the letter R in FIG. 2. It can be demonstrated that the force R is the resultant of force components $F_1$ and $F_2$, the component $F_1$ acting at a right angle to the section 22 at the edge 16 of the opening 15, and the force $F_2$ acting downward through the section 22. Thus the force $F_1$ resists the force of the users lower back which tends to collapse the inverted Vee, and the force $F_2$ produces a counterclockwise moment about the contact point 30 of the rear panel 12 with the ground which is equal and opposite to the moment created as the user leans backward against the front panel 11. The assembly 10 remains firmly in place against the ground, and has a greatly reduced tendency to pivot rearward and collapse. The lower edge 17 of the front panel 11 does not necessarily have to remain in contact with the ground, but can float upward slightly, or be pushed into the ground, depending upon the arrangement of the drape 24 as the user sits down. The wrap and overlap of the rear towel portion 21 around the lower section 22 of the panel 11 produces a self-tighting effect which precludes the wrapped towel portion from coming loose from the panel. The rough surface texture of most terry-cloth towels enhances this effect.

It is within the scope of the present invention to replace the towel 20 with a fabric that is fastened to the panel 11 at the level of the edge 16, although the use of a beach towel, as shown, is preferred for reasons of convenience. Such point of attachment must be high enough to provide an angle between the resultant force R and the plane of the section 22. Of course the panel 12 can be provided with an identical opening 15 so that the towel 20 can be secured to either panel. The panels 11 or 12 need not be solid members as shown, so long as there is a structural arrangement that provides the edge 13 located well above the ground-contacting edge 17. Although other fabrics might be used instead of a beach towel 10, it will be recognized that hotels and the like usually furnish towels which can be used in combination with the folding panels 11, 12, so that a traveler need only pack the panel assembly in his or her suitcase. Since the panels fold flat and are light weight and very compact, great convenience is achieved.

It now will be recognized that a new and improved back rest or support has been provided which is easily carried and set up, and which will not fold backward and collapse during use. The device is simple and economic to manufacture, and is a vast improvement over devices known to applicant. Since certain changes of modifications may be made in the disclosed embodiment without departing from the inventive concepts involved, it is the aims of the appended claims to cover all such changes and modification falling within the true spirit and scope of the present invention.

What is claimed is:

1. A back support assembly for use on a beach or the like, comprising: front and rear members pivotally attached to one another at adjacent upper edges so that said members can be set up on the ground in an inverted vee configuration, said front and rear members having lower ground-engaging edges; and fabric means secured to said front member along a horizontal line spaced above said lower ground-engaging edge of said front member and extending outwardly thereof so as to provide an unsupported draped section extending between said line and the ground, whereby a user sitting on said fabric means and leaning back against said front member places said draped section in tension which provides one force component resisting collapse of said members and another force component which resists rearward tilting of the upper edges of said members, said one force component acting outwardly at said line and tending to pull said front member forward, said other force component acting downwardly through said front member at said line to produce a rotational force on said assembly about the said ground-contacting lower edge of said rear member, said front member being a solid panel having a lower portion and an opening formed in the said lower portion, said opening having a lower surface that defines said horizontal line, said lower portion having a section that extends between said surface and said ground-contacting lower edge of said front member.

2. The assembly of claim 1 wherein said fabric means is a towel having a portion thereof extending through said opening and wrapped more than one full turn around said section of said front member which extends between said lower surface of said opening and said lower ground-engaging edge of said front member.

3. A back support assembly for use on a beach or the like, comprising: front and rear panel members having upper and lower edges and being pivotally attached to one another at said upper edges so that said members can be set up on the ground in an inverted vee configuration, said front panel member having an opening formed therein between the said upper and lower edges thereof, there being a bottom section of said front panel between said opening and said lower edge of said front panel, said opening having a lower surface; and a towel having an end portion extending through said opening and wrapped more than one full turn around said bottom section, said towel being draped forward from said lower surface of said opening to a point of contact with the ground, whereby tension in the draped portion of said towel which is generated as the user leans back against said front panel member produces forces which prevent collapse and overturning of said members.

4. The assembly of claim 3 wherein said tension is the resultant of an outward force component which resists collapse of said panel members and a downward force component which resists overturning of said panel members.

5. The assembly of claim 4 wherein said end portion of said towel has a terminal edge that is positioned on the rear side of said bottom section of said front panel member about one-half the distance between said lower surface of said opening and the said lower edge of said front panel member.

6. The assembly of claim 5 wherein said lower surface of said opening is substantially straight and parallel to said lower edge of said front panel member.

7. The assembly of claim 6 wherein said opening is generally rectangular in shape.

* * * * *